US005330872A

United States Patent [19]

Materazzi et al.

[11] Patent Number: 5,330,872

[45] Date of Patent: Jul. 19, 1994

[54] LIQUID COLORED TONER COMPOSITIONS

[75] Inventors: Peter E. Materazzi, Southington, Conn.; Barry F. Nelsen, Mountain Lakes, N.J.

[73] Assignee: Olin Corporation, Stamford, Conn.

[21] Appl. No.: 42,912

[22] Filed: Apr. 5, 1993

Related U.S. Application Data

[63] Continuation-in-part of Ser. No. 765,625, Sep. 25, 1991, Pat. No. 5,238,762, which is a continuation-in-part of Ser. No. 657,012, Feb. 15, 1991, Pat. No. 5,116,705, which is a continuation-in-part of Ser. No. 498,785, Mar. 26, 1990, abandoned.

[51] Int. Cl.[5] ..... G03G 9/00

[52] U.S. Cl. ..... 430/115; 430/45; 430/114

[58] Field of Search ..... 430/45, 115, 114

[56] References Cited

U.S. PATENT DOCUMENTS

| | | | |
|---|---|---|---|
| 3,668,127 | 6/1972 | Machida et al. . | |
| 3,900,412 | 8/1975 | Kosel | 252/62.1 |
| 3,993,483 | 11/1976 | Maki et al. | 96/1 LY |
| 4,360,580 | 11/1982 | Tsubuko et al. | 430/137 |
| 4,378,422 | 3/1983 | Landa et al. . | |
| 4,507,377 | 3/1985 | Alexandrovich . | |
| 4,575,478 | 3/1986 | Ohno . | |
| 4,732,831 | 3/1988 | Riesenfeld et al. | 430/60 |
| 4,734,352 | 3/1988 | Mitchell | 430/60 |
| 4,760,009 | 7/1988 | Larson . | |
| 4,786,572 | 11/1988 | Haku et al. | 430/60 |
| 4,786,576 | 11/1988 | Bujese et al. | 430/126 |
| 4,789,616 | 12/1988 | Croucher et al. | 430/109 |
| 4,794,651 | 12/1988 | Landa et al. . | |
| 4,798,778 | 1/1989 | El-Sayed et al. | 430/115 |
| 4,812,377 | 3/1989 | Wilson et al. | 430/109 |
| 4,855,207 | 8/1989 | Tsubuko et al. | 430/45 |
| 4,925,766 | 5/1990 | Elmasry et al. | 430/45 |
| 4,946,753 | 8/1990 | Elmasry et al. | 430/45 |
| 4,971,883 | 11/1990 | Chan et al. | 430/114 |
| 4,978,598 | 12/1990 | Elmasry et al. . | |
| 4,988,602 | 1/1991 | Jongewaard et al. . | |

FOREIGN PATENT DOCUMENTS

| | | |
|---|---|---|
| 5032624 | 10/1975 | Japan . |
| 6076755 | 10/1983 | Japan . |
| 5428629 | 12/1987 | Japan . |

*Primary Examiner*—Steve Rosasco

*Attorney, Agent, or Firm*—William A. Simons

[57] ABSTRACT

A liquid toner composition comprising:

A. a colored predispersion comprising a homogeneous mixture of at least one selected nonpolymeric resin material, at least one selected polymeric plasticizer, at least one selected colorant material, and at least one selected maleic anhydride adduct of polyolefin;

B. an aliphatic hydrocarbon carrier liquid having a conductivity of $10^{-9}$ MHOS/cm or less, a dielectric constant of 3 or less, and a flash point of 100° F. or greater; and C. external charge system comprising an interacting mixture of a maleic anhydride adduct of polyolefin and an amiphipathic copolymer.

14 Claims, No Drawings

LIQUID COLORED TONER COMPOSITIONS

CROSS-REFERENCES TO RELATED APPLICATIONS

This patent application is a continuation-in-part U.S. patent application Ser. No. 07/765,625,now U.S. Pat. No. 5,238,762, filed Sep. 25, 1991 with Peter E. Materazzi as the named inventor, which is a continuation-in-part U.S. patent application Ser. No. 07/657,012, now U.S. Pat. No. 5,116,705, filed on Feb. 15, 1991 that issued as U.S. Pat. No. 5,116,705 with Peter E. Materazzi as the named inventor on May 26, 1992, which is a continuation-in-part U.S. patent application Ser. No. 07/498,785, filed on Mar. 26, 1990 with Peter E. Materazzi as the named inventor and now abandoned. All of these applications and the patent are incorporated herein by reference in their entireties.

BACKGROUND OF THE INVENTION

1. Field of the Invention

The present invention relates to a liquid colored toner composition suitable for use in contact and gap electrostatic transfer processes. The present invention further relates to a liquid colored toner composition which comprises a mixture of a carrier liquid, a selected charge system, and a colored predispersion which is made by mixing together at least one selected nonpolymeric resin material, at least one selected polymeric plasticizer, at least one selected colorant material and at least one selected maleic anhydride adduct of polyolefin.

2. Brief Description of the Prior Art

Liquid toner compositions for use in developing latent electrostatic images are well-known in the art. Additionally, liquid toner compositions suitable for use in contact electrostatic transfer processes, as well as liquid toner compositions suitable for use in gap electrostatic transfer processes, are documented in the patent literature. In the contact electrostatic transfer process, a toned image is formed on a suitable photoreceptor after which the toned image is brought into contact with a receiver substrate such as paper. An electrostatic potential opposite in polarity of the toner is applied to the receiver substrate (usually by use of a corona) which causes transfer of the toner from the photoreceptor to the receiver substrate. Some commercial examples of this process are the Ricoh and Savin plain paper liquid copiers.

The gap electrostatic transfer process is generally similar to contact transfer except the receiver substrate does not contact the photoreceptor. Instead, it is physically separated by an 0.5 to approximately 10 mil gap. This gap can be filled with carrier liquid or air. Two different approaches to this process are described by Landa (U.S. Pat. No. 4,378,422) and by Bujese (U.S. Pat. No. 4,786,576). The liquid toner requirements for contact and gap electrostatic transfer are quite similar.

Most of the early liquid toner patent literature relates to toners intended for use in relatively low quality black and white copiers. While many of these disclosures are suitable for their intended purposes, most are clearly unacceptable for use in high quality color imaging.

Many recent patents have issued which describe liquid toners intended for high quality color imaging. Many of these toners can be used in contact and gap electrostatic transfer processes. While most of these later toners are superior to those in the early black and white toners, many problems still remain. Specifically, concerning liquid toners intended for contact or gap electrostatic transfer multicolor imaging processes, there remains a need for toners which possess all of the following properties:

(A) Charge Properties Which Are Independent and Unaffected by Pigment Choice Adverse charging effects from pigments perhaps, the greatest source of trouble for the liquid toner formulator. Pigments are usually heterogeneous materials containing substantial amounts of impurities in addition to post-added dispersants and flow agents. Different pigments vary considerably in their composition of these compounds, and even batch-to-batch variations can be quite significant. Reducing, or eliminating, the charging effects due to these compounds is a major first step in designing charge stable toners. It is important to use charge stable toners for multicolor imaging in order to achieve and maintain color balanced imaging. There are a number of recent liquid toner patents which attempt to address the problem of charge stability. Most relate to specific charge directors, and/or specific charge adjuvants, and generally avoid the issue of solving the pigment problem. Charge independence from pigments gives an added benefit of allowing different color toners to be formulated having the same charge and imaging properties. These toners can be blended to a desired shade and used in a color-matching system, such as the PANTONE color-matching process which is popular in the printing ink industry. Different color toners, which have similar charging and imaging properties, will hereafter be called "colorblind" toners. It has been found that certain toners containing particles which are not swellable in the liquid carrier may be made colorblind.

(B) High Transparency

This property is generally achieved by mechanically reducing pigment agglomerates down as close as possible to the primary pigment particle size, around 0.05 to 0.5 microns, and dispersing the particles as homogeneously as possible. A means must be present to keep the pigment particles from re-agglomerating. This is usually achieved by dispersing the pigment particles in a rigid or semirigid resin binder, although static stabilization in solution can also be used. It has been found that it is extremely difficult to disperse substantial amounts of pigments (i.e., $\geqq 10$ wt. %) down to their primary particle sizes in most of the common polymeric binders used in previous liquid toners. Examples of these types of binders include polystyrenes, polymethylmethacrylates, polyesters, and polyvinyl acetates. In addition, virtually all crystalline waxes and crystalline homopolyethylene resins, which are very popular in the black and white toner art, are not transparent and, thus, cannot be used in substantial amounts in color toners. Also, mixing two transparent resins together which are not soluble in each other will usually result in a hazy, nontransparent composite. The above limitations further limit the choice of suitable resin binders for high quality color toners.

(c) Ability To Replenish Developer Bath Using High-Solids Concentrate

This issue is rarely addressed, if ever, in the liquid toner patent literature. However, it is very important when considering medium to high speed multicolor printing.

For example, take the case of when more than a hundred 8.5×11 inch four-color prints per minute are being made. The page coverage can range from 0 to 400% with 100 to 200% coverage being common. A substantial amount of toner may be consumed. To illustrate the problem, consider printing an 8½×11 inch image at 80% coverage, wherein the weight of toner solids applied per page was 0.167 grams and the printing rate was 200 pages per minute. Then the amount of toner concentrate and Isopar® carrier liquid used per hour would be as shown in Table below:

| | Toner Usage | |
|---|---|---|
| % of Solids in Liquid Toner | Gallons of Toner Conc. Per Hour | Gallons of Isopar Solvent Per Hour |
| 10 | 7.14 | 6.43 |
| 20 | 3.57 | 2.86 |
| 30 | 2.38 | 1.67 |
| 40 | 1.79 | 1.07 |

Clearly, the data in this table shows that a high solids concentrate replenishment is very beneficial because less gallons of toner concentrate and less gallons of Isopar liquid carrier will be used. Most of the liquid toners suitable for contact, or gap, electrostatic transfer, described in the literature, are made with carrier liquid swelled particles which tend to gel heavily around 20% solids. Most of these toners are not acceptable for use in a high solids replenishment system. It has been found that liquid toners, of the present invention, which contain hard and nontacky particles that are not swelled by the carrier liquid in the 0.5 to 10 micron particle size range can be made free flowing even at a high solids content. These toners of the present invention are acceptable for use in contact, or gap, electrostatic transfer processes.

(D) Ability To Produce High Resolution Images

High quality, multicolor half-tone imaging generally requires the ability to image greater than 5 to 95% half-tone dots using a 150 line screen ruling along with at least a 10 micron limiting resulting resolution. Toner image spread also needs to be reduced or eliminated to avoid excess dot gain. Many recent liquid toner patents describe various additives and preferred embodiments designed to achieve this desired result. The toners disclosed in this invention achieve the above criteria by using hard, compression-resistant resin particles in a particular particle size range.

(E) Good Transfer Properties

The toners of the present invention have transfer properties suitable for use with both contact and gap electrostatic transfer processes.

(F) Ability To Easily Adjust Charge Magnitude

The toners of the present invention may have their charge magnitudes adjusted after the liquid toner has been formulated. This may be done by changing the amount of the external charge system to the relative amounts of the colored predispersion and liquid carrier. Previously, one having skill in the art had to carefully select the raw materials used. Also, the formulator had to take into consideration the charge magnitudes with the selected raw materials. The present invention allows for post-formulating adjustments of toner particle charge magnitudes of both original toners and replenishment toners, whereas prior art external charge directors may effect only the bulk charge magnitude.

3. Discussion Of Possible Relevant References

Machida et al. (JP-50-32624) describes a liquid developer for electrostatic photography transfer which contains a liquid carrier; pigments or dyes; resins which are insoluble in liquid carrier and are either nonswellable or swellable in the liquid carrier; plasticizers which are insoluble in carrier liquid and have a high dielectric constant and low electrical resistance. Isopar G or H are among the liquid carriers disclosed. Carbon black and other pigments and dyes are disclosed. The disclosed class of nonswellable resins include Pentalyn H which is a maleic-modified rosin. Disclosed plasticizers include dimethyl phthalate, n-butanol, methylethyl ketone, ethylene glycol and polyester plasticizers, among others. All of the plasticizers disclosed in this Japanese Kokai flow or are liquid at room temperature (20–30° C.). The reference teaches alternate methods for making their liquid developers. One method disclosed is to knead the pigment or dye, the resin or resins and the plasticizer together in roll mill. This mixture is combined with liquid carrier to form microgranules in a ball mill or jet mill. The resultant microgranules are dispersed in more liquid carrier. The resultant dispersion is ground to the desired particle size in a ball mill or colloid mill or the like in order to make concentrated liquid developer. The concentrate is diluted with more carrier liquid to obtain desired solids content for machine use. More plasticizer may be added during the dilution step. One disadvantage is that the liquid or flowable plasticizer can render the toner particles tacky and will not flow easily in high solids concentration.

Maki et al. (U.S. Pat. No. 3,993,483) describes liquid electrostatic transfer toners which contain at least one compound of Group (A) and a least one compound of Group (B). Group (A) compounds include rosin modified phenol resin, rosin modified maleic acid resin, and rosin modified pentaerythritol. Group (B) compounds include low molecular polyethylene, ethylene ethylacrylate copolymers, ethylene vinylacetate copolymer, and low molecular polypropylene. The ratio of compound A to B varies from 100:60 to 100:400. The toners are prepared simply by ball milling the above together with a colorant and an aromatic carrier liquid (e.g., Solvesso 100), usually at an elevated temperature. These toners of Maki et al. are not acceptable for high quality color printing for the following reasons:

First, the pigments are directly exposed to the carrier liquid which eliminates the colorblind property. Second, the binders, particularly the (B) components, are substantially swelled with the carrier liquid and will gel at a high solids content. High solids replenishment is not possible.

Machida et al. (U.S. Pat. No. 3,668,127) describes liquid toners characterized as having pigment particles coated with a resinous layer consisting of at least two layers of which the first or inner resin layer is directly coated on the pigment particles and is comprised of a resin which is insoluble in the carrier liquid while the outermost layer comprises a resin capable of somewhat swelling in the carrier liquid. Resins disclosed for the first layer include styrene-butylmethacrylate (7:3), styrene-lauryl methacrylate (9:1), methylmethacrylate-butylmethacrylate, among others. Resins suitable for the swelled layer include styrene-lauryl methacrylate (1:1) and styrene-butylmethacrylate-acrylic acid (3:7:1), among others. The use of modified natural rosins as such binder resins and the use of plasticizers are not taught. The patentees claim that encapsulating the pigments in this manner gives improved charge stability, gives uniform charge, and reduces background staining. This might appear to be a good way to make a colorblind liquid toner. However, as the toner particles settled, they would form a solid mass. As such, the disclosed toners are not suitable for high solids replenishment.

Tsubuko et al. (U.S. Pat. No. 4,360,580) describes liquid developers suitable for contact electrostatic transfer which are prepared by blending in the carrier liquid:

(1) a resin dispersion A comprising a polymer obtained from at least one kind of resin which is difficult to dissolve, or insoluble, in the carrier liquid and at least one kind of monomer which is soluble in said resin; and (2) a pigment coated with resin B which is different than resin dispersion composition A and is substantially insoluble in the carrier liquid.

Dispersion A is made by polymerizing, for example, lauryl methacrylate in the presence of a natural rosin or modified natural rosin. It acts as a dispersant for the colored B composition. Resins cited for component B include natural rosins and modified natural rosins. Pigments are kneaded into the B resin before dispersing with component A. Optionally, a charge controlling monomer, such as acrylic acid, may be polymerized in the presence of resin B and the pigments during the kneading process. The patentees claim improved polarity controlling ability, improved storage stability, and improved transfer property. The incorporation of plasticizers is not taught. Also, the term "substantially insoluble" is not defined. Many of the cited resins for use in component B are known to swell and/or dissolve somewhat in the carrier liquid. In addition, many of the resins cited for component B have softening points above 100° C. In this case, poor image fusing would be expected unless the particles were swelled and plasticized by the carrier liquid. These disclosed toners have not demonstrated the colorblind property and probably cannot be used in a high solids replenishment system.

Several other liquid electrostatic toner patents have issued which describe coating the pigments with so-called carrier nonsoluble natural rosins or modified natural rosins. None of these approaches have been successful in achieving all the criteria needed for high quality color imaging using the contact, or gap, electrostatic transfer processes. Not surprisingly, most recent color liquid toner work has concentrated on using man-made polymeric binders, particularly polyesters and polyethylenes.

Alexandrovich (U.S. Pat. No. 4,507,377) describes liquid toners comprised of a compatible blend of at least one polyester resin and at least one polyester plasticizer. The resin and plasticizer are dissolved in an aromatic solvent and ball milled together with pigments and a dispersant to produce a concentrated dispersion. The concentrate is next diluted in the carrier liquid where the resin and plasticizer precipitate out of solution and coat the pigments. This patent teaches the importance of selecting compatible binder components in order to achieve high transparency. Compatible means that the components are soluble in each other and remain clear and transparent when mixed together. This patent also teaches the importance of using a plasticizer which is not soluble in the carrier liquid. One big disadvantage in this disclosure is the use of an aromatic solvent in making the concentrated dispersion. The pigments are exposed to this aromatic solvent during the dispersion step which adversely affects the colorblind property.

Wilson et al. (U.S. Pat. No. 4,812,377) describes specific polyester resins which are suitable for liquid or dry toners. In this patent, the pigments are kneaded into the resin prior to ball milling in the carrier liquid. The patentees mention that these particular resins are brittle and can be easily ground to small particle sizes. Additionally, the patentees claim good pigment dispersing ability with these resins.

Landa et al. (U.S. Pat. No. 4,794,651) and Larson (U.S. Pat. No. 4,760,009) describe polyethylene-based liquid toners which are prepared, for example, by:

(1) heating the polyethylene resin and pigment in the carrier liquid to plasticize and dissolve the resin;

(2) ball milling the mixture, at an elevated temperature, to finely disperse the pigments; and (3) cooling the mixture, with or without grinding, to precipitate the resin onto the pigment particles.

When cool, the diluted composition contains toner particles which are somewhat swelled and plasticized by the carrier liquid. The toner particles have a fiberous structure which reduces compressibility during contact electrostatic transfer and also improves transfer efficiency. These toners have demonstrated the capability of producing high quality color images in certain contact electrostatic transfer processes. However, recently a large number of patents have been issued (mostly to DuPont) which describe specific charge directors and/or charge adjuvants intended to improve these toners. The data in these patents indicate that the imaging properties of these toners are very dependent upon the pigments used. The colorblind property has not been demonstrated and charge stability may be a problem. Also, these polyethylene-based toners tend to gel heavily at a high solids content making them unsuitable for use in a high solids replenishment system.

Other U.S. patents which are directed to liquid electrostatic toners, which might be relevant to the present invention, include the following:

Kosel (U.S. Pat. No. 3,900,412) teaches a liquid toner having dispersion phase of pigments in a liquid hydrocarbon system. The toner contains an amphipathic polymeric molecules composed of two moleties. One moiety being a dispersant and a fixative to bond the molecules to a substrate, while the second moiety has a very small particle size. The first part of the amphipathic polymeric being dissolved in the liquid hydrocarbon system, while the second part being in the pigment phase.

Landa et al. (U.S. Pat. No. 4,378,422) discloses a gap electrostatic imaging process which uses a developing liquid comprising an insulating carrier liquid and toner particles.

Riesenfeld et al. (U.S. Pat. No. 4,732,831) teaches a liquid electrostatic master which contains a combination of specific polymeric binder, an ethylenically unsaturated photopolymerizable monomer, specific chain transfer agents, and specific stabilizer.

Mitchell (U.S. Pat. No. 4,734,352) teaches liquid electrostatic developer containing (a) a nonpolar liquid carrier; (b) thermoplastic resin particles having an average by area particle size of less than 10 microns; (c) an ionic or zwitterionic compound soluble in said nonpolar liquid carrier; and (d) a polyhydroxy compound.

Bujese et al. (U.S. Pat. No. 4,786,576) teaches a liquid electrostatic toner containing an alcohol insoluble maleic modified rosin ester and an ethylene-ethylacrylate copolymer.

Croucher et al. (U.S. Pat. No. 4,789,616) teaches a liquid electrostatic toner containing a dyed polymer and amphipathic stabilizer.

El-Sayed et al. (U.S. Pat. No. 4,798,778) teaches a positive-working liquid electrostatic developer containing (a) nonpolar liquid carrier; (b) thermoplastic resin which is an ethylene homopolymer having a carboxylic acid substituent or a copolymer of ethylene and another monomer having a carboxylic acid substituent; and (c) ionic or zwitterionic compound which is soluble in said nonpolar liquid carrier.

Tsubuko et al. (U.S. Pat. No. 4,855,207) teaches wet-type electrostatic developers containing colorant particles coated with an olefin resin having a melt index of 25–700 g per 10 minutes, measured under a load of 2,160±10 g. at 190°±0.4° C.

Elmasry et al. (U.S. Pat. Nos. 4,925,766 and 4,978,598) teaches liquid electrophotographic toners containing chelating copolymer particles comprised of a thermoplastic resinous core with a Tg below room temperature, which is chemically anchored to an amphipathic copolymer steric stabilizer which is soluble in the liquid carrier solvent and has covalently attached thereto moleties of a coordinating compound and at least one metal soap compound.

Elmasry et al. (U.S. Pat. No. 4,946,753) teaches liquid electrophotographic toners wherein the toner particles are dispersed in a nonpolar carrier liquid and wherein (a) the ratio of conductivities of the carrier liquid to the liquid toner is less than 0.6 and (b) the zeta potential of said toner particles is between +60 mV and +200 mV.

Chan et al. (U.S. Pat. No. 4,971,883) teaches a negative-working electrostatic liquid developer containing (a) nonpolar liquid carrier; (b) particulate reaction product of a polymeric resin having free carboxyl groups and a specific metal alkoxide; and (c) ionic or zwitterionic charge director compound soluble in the nonpolar liquid carrier.

Jongewaard et al. (U.S. Pat. No. 4,988,602) teaches liquid electrophotographic toners containing chelating copolymer particles dispersed in a nonpolar carrier liquid, said chelating copolymer particles comprising (a) a thermoplastic resin core having a Tg of 25° C. or less and is insoluble or substantially insoluble in said carrier liquid and is chemically anchored to an amphipathic copolymer steric stabilizer containing covalently attached groups of a coordinating compound which in turn are capable of forming covalent links with organic-metallic charge directing compounds and (b) a thermoplastic ester resin that functions as a charge enhancing component for the toner. The preferred thermoplastic resins are those derived from hydrogenated rosin having an acid number between 1 and 200, a softening point in the range of 70° C. to 110° C. and being soluble in aliphatic hydrocarbon solvents.

BRIEF SUMMARY Of THE INVENTION

Accordingly, the present invention is directed to a liquid colored toner composition comprising:

A. a colored predispersion comprising a homogeneous mixture of at least one nonpolymeric resin material, at least one polymeric plasticizer, at least one colorant material and at least one maleic anhydride adduct of polyolefin;

(1) said nonpolymeric resin material which is characterized by:

(aa) being insoluble and nonswellable in the liquid carrier;

(bb) having a melting point between 60° to 180° C.; and (cc) having an acid number higher than about 100;

(2) said polymeric plasticizer characterized by:

(aa) being soluble in said nonpolymeric resin;

(bb) being insoluble in the liquid carrier; and (cc) having a melting point from about 35° C. to about 70° C.; and (3) said colorant material having an average primary particle size of less than about 0.5 microns;

(4said maleic anhydride adduct of polyolefin characterized by (aa) being partially soluble in the liquid carrier; and (bb) having an acid number higher than about 45;

and wherein said colored predispersion contains about 50% to about 98.5% by weight nonpolymeric resin; about 1% to 20% by weight polymeric plasticizer; about 0.5% to 30% by weight colorant material and about 0.5% to about 10% by weight maleic anhydride adduct of polyolefin; and B. an aliphatic hydrocarbon liquid carrier having a conductivity of $10^{-9}$ MHOS/$_{cm}$ or less, a dielectric constant of 3 or less, and a flash point of 37.7° C. or greater; and C. external charge system comprising an interacting mixture of a maleic anhydride adduct of polyolefin and an amphipathic copolymer, said maleic anhydride adduct of polyolefin characterized by:

(aa) being partially soluble in the liquid carrier; and (bb) having an acid number higher than about 45;

the weight ratio of said maleic anhydride adduct of polyolefin and amphipathic copolymer being from about 1:10 to about 10:1;

wherein said toner containing about 0.1% to about 10% by weight colored predispersion, about 99.9% to about 90% by weight of said liquid carrier and about 0.005% to about 0.25% of said external charge system and said colored predispersion particles having about 0.5–10 micron average particle size and being insoluble and non-swellable in said liquid carrier.

DETAILED DESCRIPTION

The colored predispersion (A) of the toners of the present invention are comprised of four critical ingredients, namely, (1) a nonpolymeric resin; (2) a polymeric plasticizer; (3) a colorant agent; and (4) a maleic anhydride adduct of polyolefin.

As stated above, the nonpolymeric resin (1) used in the liquid toner of the present invention must possess a specific combination of insolubility (and nonswellability), melting point and acid number characteristics. First, the nonpolymeric resin should be insoluble and nonswellable in the carrier liquid because during the colored predispersion step, the nonpolymeric resin encapsulates the colorant agents and the charge properties associated with the pigments. Thus, the majority of the colorant agent is never exposed directly to the carrier liquid. It is locked within or covered with the nonpolymeric resin which is insoluble and nonswellable in the liquid carrier. "Insoluble in the liquid carrier", as used herein for the nonpolymeric resin and the colored predispersion, means that less than 1%, preferably less than 0.5% by weight, of the nonpolymeric resin will dissolve in the liquid carrier.

"Nonswellable in the liquid carrier", as used herein for the nonpolymeric resin and the colored predispersion, means that nonpolymeric resin will not increase in weight more than about 25% by absorption after contacting with the liquid carrier at room temperature followed by removing all free liquid carrier from the nonpolymeric resin.

As stated above, the melting point of the nonpolymeric resin should be between about 60° C. and 180° C. Preferably, the melting point should be between about 70° C. and 150° C. The melting point is determined by the ring and ball method.

The acid number should be greater than 100. Acid number means the amount of KOH in mg needed to neutralize 1 gram of resin.

Preferably, the nonpolymeric resin should possess other properties. It should preferably have a Gardner color index of 11 or less. It should preferably be friable enough at room temperature to easily grind to a small particle size using conventional ball milling equipment, for example, an S-1 type attritor. It should preferably have excellent pigment dispersing properties even in the absence of a liquid such as the liquid carrier. They should preferably be easy to use in conventional compounding equipment, for example, a compounding twin-screw extruder. Preferably, the nonpolymeric resin is completely soluble (i.e., forms a clear, nonhazy solution containing no visible precipitates) in ethanol or diethylene glycol at a 1 to 50 wt. % solids loading. Preferably, the nonpolymeric resin is not soluble in water or in mineral spirits (i.e., a mixture of aliphatic, aromatic, or naphthenatic hydrocarbon liquids having a Kauri-Butanol value of 30 to 50) at a 1 to 50 wt. % solids loading.

The most suitable materials for the nonpolymeric resin (1) are maleic modified rosins having acid numbers of 100 or greater. These are also sometimes called "rosin modified maleic acid resins". These include rosins modified with maleic anhydride, maleic and/or fumaric acid, or mixtures thereof. These rosins are chemically modified forms of natural wood rosin, gum rosin, or tall oil rosin. Natural rosins consist of approximately 90% resin acids which are mostly abietic acid or its related isomers and about 10% neutral resins with most structurally similar to abietic acid. Abietic acid contains both a reactive monocarboxylic acid functionality and, also a reactive diene structure. In the maleic modified rosins suitable for this invention both functionalities may be reacted as follows:

1. The diene structure is reacted with maleic anhydride, maleic acid, or fumaric acid by Diels-Alder reaction. Increasing the reacted amount of maleic anhydride or fumaric acid increases the acid number of the rosin. Increasing the acid number in this manner also further increases the melting point, gloss, and hardness properties.
2. Next, some of the acid groups are esterified with a suitable polyalcohol—examples include pentaerithritol, di- and tri-pentaerithritol, mannitol, sorbitol, among others. This esterification links also tends to increase the melting point, hardness, and gloss properties.

Examples of acceptable nonpolymeric maleic modified rosins suitable for component (1) include:

| | Manufacturer | Acid No. | M.P. °C. |
|---|---|---|---|
| Unirez 709 | Union Camp | 117 | 115 |
| Unirez 710 | Union Camp | 300 | 145 |
| Unirez 757 | Union Camp | 115 | 130 |
| Unirez 7019 | Union Camp | 250 | 135 |
| Unirez 7020 | Union Camp | 110 | 130 |
| Unirez 7024 | Union Camp | 235 | 120 |
| Unirez 7055 | Union Camp | 193 | 155 |
| Unirez 7057 | Union Camp | 123 | 125 |
| Unirez 7080 | Union Camp | 133 | 115 |
| Unirez 7083 | Union Camp | 235 | 111 |
| Unirez 7089 | Union Camp | 110 | 125 |
| Unirez 7092 | Union Camp | 188 | 135 |
| Unirez 7093 | Union Camp | 215 | 135 |
| Unirez 8112 | Union Camp | 115 | 128 |
| Unirez 8115 | Union Camp | 116 | 128 |
| Pentalyn 255 | Hercules | 196 | 171 |
| Pentalyn 261 | Hercules | 205 | 171 |
| Pentalyn 269 | Hercules | 200 | 177 |
| Pentalyn 856 | Hercules | 140 | 131 |
| Pentalyn 821 | Hercules | 201 | 150 |

There are many other chemically modified rosin materials cited in the prior art. Many of these rosins are often cited as being carrier liquid insoluble in the patent literature. However, none of these other rosins meet all our criteria for this component (1), and most actually swell and/or dissolve into the carrier liquid. Examples of these resins, which are not acceptable for use in component (1), include natural rosin, rosin esters, hydrogenated rosin, hydrogenated rosin esters, dehydrogenated rosins, polymerized rosin esters, phenolic modified rosins and rosin esters, and alkyl modified rosins.

While maleic modified rosins having acid numbers of 100 or greater are the preferred resins for use as component (1), it is anticipated that other nonpolymeric resins which meet the criteria outlined previously may also be used.

The second critical component of the colored predispersion is a polymeric plasticizer (2) which is defined as having the following properties:

1. Soluble in the nonpolymeric resin. Soluble means that at a temperature above their melting points the polymeric plasticizer will completely dissolve into the nonpolymeric resin.
2. Insoluble in the liquid carrier. The phrase "insoluble in the liquid carrier", as used herein for the polymeric plasticizer, means that less than 1%, preferably less than 0.1% by weight, of the polymeric plasticizer will dissolve in the liquid carrier.
3. A melting point not less than 35° C. and not greater than 70° C.

The plasticizer suitable for use in the toner composition of this invention should also be compatible with the nonpolymeric resin, colorant, and maleic anhydride adduct of polyolefin.

We have found that the most preferred materials for the polymeric plasticizer (2) are polyethylene glycols with molecular weights ranging from about 1,000 to about 10,000. Other medium to high molecular weight polyols, such as polyethylene oxide and polyethylene glycol methyl ether, may also be used. Specific examples include:

| Compound | M.W. | Melt Temp. (°C.) | Viscosity (210° F.) CPS |
|---|---|---|---|
| Polyethylene Glycol | 1,000 | 39 | 17.4 |
| Polyethylene Glycol | 1,500 | 45 | 28.0 |
| Polyethylene Glycol | 2,000 | 49 | 56.0 |
| Polyethylene Glycol | 3,400 | 55 | 90.0 |
| Polyethylene Glycol | 8,000 | 62 | 800.0 |
| Polyethylene Glycol | 10,000 | 63 | 870.0 |
| PEG Methyl Ether | 2,000 | 52 | 54.6 |
| PEG Methyl Ether | 5,000 | 59 | 613.0 |
| Polyethylene Oxide | 100,000 | 66 | — |

These compounds meet the criteria for solubility properties, nonpolymeric resin compatibility, and suitable melting temperatures. In addition, these compounds are ideal because they exhibit very sharp melt points, at which temperatures the viscosity drops dramatically. In other words, these compounds become low viscosity solvents when heated only a couple of degrees above their melting temperatures. This property greatly decreases the fusing temperatures of the disclosed toners and, also, is used to ensure that a smooth, even film is formed on the toned image after fusing. This allows for the use of high melting point nonpolymeric resins which do not swell in the liquid carrier. At room temperature, these polymeric plasticizers are hard, wax-like materials which are not tacky. This is unlike most other known plasticizers. This property enables the toner particles of the present invention to be very hard, friable, and nontacky at room temperature. Surprisingly, even though these polymeric plasticizers are solids at room temperature, it has been found that they greatly improve the flexibility and crack resistance of the fused toned images. It is believed that it is the polymeric nature of these plasticizers which gives us this property.

The third critical component of the colored predispersion is one or more colorant agents (3). These are preferably dry organic or inorganic pigments or dry carbon black. Resinated pigments may also be used, provided the resins meet the criteria for component (1) above. Solvent dyes which are soluble in alcohols or glycols and insoluble in aliphatic hydrocarbon solvents may also be used.

Most common organic pigments may be used in the composition of this invention. The pigments are used in amounts of from about 0.5 to about 30% preferably from about 5 to about 15% by weight solids in the toner. Pigments suitable for use herein include copper phthalocyanine blue (C.I. Pigment Blue 15), Victoria Blue (C.I. Pigment Blue 1 and 2), Alkali Blue (C.I. Pigment Blue 61), diarylide yellow (C.I. Pigment Yellow 12, 13, 14, and 17), Hansa yellow (C.I. Pigment Yellow 1, 2, and 3), Tolyl orange (C.I. Pigment Orange 34), Para Red (C.I. Pigment Red 1), Naphthol Red (C.I. Pigment Red 2, 5, 17, 22, and 23), Red Lake C (C.I. Pigment Red 53), Lithol Rubine (C.I. Pigment Red 57), Rhodamine Red (C.I. Pigment Red 81), Rhodamine Violets (C.I. Pigment Violet 1, 3, and 23), and copper phthalocyanine green (C.I. Pigment Green), among many others. Many of these pigments are used in Examples 7 to 42, presented herein. Inorganic pigments may also be used in the toner composition of this invention. These include carbon black (C.I. Pigment Black 6 and 7), chrome yellow (C.I. Pigment Yellow 34), iron oxide (C.I. Pigment Red 100, 101, and 102), and Prussian Blue (C.I. Pigment Blue 27), and the like. Solvent dyes may also be used, provided they are insoluble in the carrier solvent and soluble in the binder resin. These are well-known to those skilled in the art.

The fourth critical component of the colored predispersion is a maleic anhydride adduct of polyolefin (4) which is defined as having the following properties:

1. Partially soluble in the liquid carrier. The phrase "being partially soluble in the liquid carrier," as used herein for the maleic anhydride adduct of polyolefin, means from 1% to about 75% of the maleic anhydride adduct of polyolefin will dissolve in the liquid carrier at room temperature (20–25° C.).
2. Having an acid number greater than 45, preferably about 80 to 300. Acid number means the amount of KOH in mg needed to neutralize 1 gram of maleic anhydride adduct of polyolefin.

The preferred maleic anhydride adduct of polyolefin is CERAMER 1608 available from Petrolite Specialty Polymers Group of Tulsa, Okla. This material has a melting point of 77° C. (as measured by ASTM D127), acid number of 160 (BWM 3.01 mg KOH/gram of sample); and a saponification number of 212 (BWM 3.02 mg KOH/gram sample).

The nonpolymeric resin (1), polymeric plasticizer (2), colorant (3), and maleic anhydride adduct of polyolefin (4) are preferably mixed and kneaded together by heating the mixture at or above the melting temperatures of the nonpolymeric resin and plasticizer and compounding the mixture under high sheer and pressure forces. A twin-screw compounding extruder is preferred; however, other kneading equipment known in the art, such as a Banbury, three roll mill, and the like, may also be used. The purpose of this preferred kneading step is to (a) completely dissolve the polymeric plasticizer(2) and the maleic anhydride adduct of polyolefin (4)into the nonpolymeric resin (1); and (b) completely and homogeneously disperse the colorants (3) into the nonpolymeric resin (1) and the polymeric plasticizer (2). Organic pigments should ideally be broken down to their primary particle sizes after which each pigment particle is completely wetted and coated by the resin and plasticizer mixture. This ensures that maximum color strength and transparency is achieved.

After the resin (1), plasticizer (2), colorants (3), and maleic anhydride adduct of polyolefin (4) are fully kneaded and cooled, a small sample is usually checked to ensure that the dispersion is complete. This can be checked by preparing a thin film coating of the blend, for example, by smearing a small piece on a hot microscope slide and viewing the thin film under an optical microscope. Most organic pigments have average primary particle sizes in the 0.05 to 0.5 micron range which is too small to readily see in most optical microscopes. Compounding is complete when the sample has a smooth, even color. Small amounts of large, visible particles are generally acceptable. However, large amounts of visible particles, or a grainy appearance, means that the kneading process is not complete and must be repeated. It is important that the kneading step be done in the absence of any solvent or the colorblind property may be lost.

After the kneading step, the blend is usually broken into a coarse powder (about 100 micron particle size) using, for example, a Fitz mill, corn mill, mortar and pestle, or a hammer mill.

The acceptable and preferred ranges of nonpolymeric resin (1), polymeric plasticizer (2), colorants (3), and maleic anhydride adduct of polyolefin (4) are as follows:

| | Acceptable | Preferred | Most Preferred |
|---|---|---|---|
| Nonpolymeric Resin (1) | 50–98.5% | 70–90% | 73–84% |
| Polymeric Plasticizer (2) | 1–20 | 5–15 | 6–12 |
| Colorants (3) | 0.5–30 | 5–15 | 8–12 |
| Maleic anhydride adduct of polyolafin (4) | 0.5–10 | 1–5 | 1.5–3 |

The completely kneaded blend of nonpolymeric resin (1), polymeric plasticizer (2), colorants (3), and maleic anhydride adduct of polyolefin (4) will hereafter be referred to as colored predispersion (A).

In addition to the colored predispersion (A), the toner contains an aliphatic hydrocarbon carrier liquid (B) having a conductivity of $10^{-9}$ MHOS/cm or less, a dielectric constant of 3 or less, a flash point of 100° F. or greater, and, preferably, a viscosity of 5 cps or less.

The preferred organic solvents are generally mixtures of $C_9$–$C_{11}$ or $C_9$–$C_{12}$ branched aliphatic hydrocarbons. The liquid carrier (B) is, more preferably, branched chain aliphatic hydrocarbons and more particularly Isopar G, H, K, L, M, and V. These hydrocarbon liquids are narrow cuts of isoparaffinic hydrocarbon fractions with extremely high levels of purity. For example, the boiling range of Isopar G is between 157° and 176° C., Isopar H between 176° and 191° C., Isopar K between 177° and 197° C., Isopar L between 188° and 206° C., Isopar M between 207° and 254° C., and Isopar V between 254.4° and 329.4° C. Isopar L has a midboiling point of approximately 194° C. Isopar M has a flash point of 80° C. and an auto-ignition temperature of 338° C. Stringent manufacturing specifications ensure that impurities, such as sulphur, acids, carboxyls, and chlorides, are limited to a few parts per million. They are substantially odorless, possessing only a very mild paraffinic odor. They have excellent odor stability and are all manufactured by the Exxon Corporation. High purity normal paraffinic liquids Norpar® 12, Norpar 13, and Norpar 15, also manufactured by Exxon Corporation, may be used. These hydrocarbon liquids have the following flash points and auto-ignition temperatures.

| Liquid | Flash Point (°C.) | Auto-Ignition Temp. (°C.) |
|---|---|---|
| Norpar 12 | 69 | 204 |
| Norpar 13 | 93 | 210 |
| Norpar 15 | 118 | 210 |

All of these liquid carriers have vapor pressures at 25° C. are less than 10 Tort. Isopar G has a flash point determined by the tag closed cup method of 40° C. Isopar H has a flash point of 53° C. determined by ASTM D 56. Isopar L and Isopar M have flash points of 61° C. and 80° C., respectively, determined by the same method. While these are the preferred dispersant nonpolar liquids, the essential characteristics of all suitable dispersant nonpolar liquids are the electrical volume resistivity and the dielectric constant. In addition, a feature of these liquid carriers is a low Kauri-Butanol value less than 30, preferably in the vicinity of 27 or 28, determined by ASTM D 1133.

The third critical ingredient of the present liquid toner is a selected external charge system (C). This external charge system is an interacting mixture of a maleic anhydride adduct of polyolefin and an amphipathic copolymer. The maleic anhydride adduct of polyolefin is the same as defined above. The term "interacting mixture" includes an intimate mixture of the adduct and the amphipathic copolymer with or without chemical reactions between them. There could be simple hydrophilic attractions between their polar functionalities or more complex micelle structures. The exact interaction is not known. The amphipathic copolymer may be either a graft-type amphipathic copolymer or a solution-type amphipathic copolymer. The preferred weight ratio of maleic anhydride adduct of polyolefin to amphipathic copolymer in the external charge system is from about 5:1 to about 1:5.

Preferred amphipathic graft-type polymers are characterized as having a carrier soluble component and a grafted carrier insoluble component. The grafted insoluble component should preferentially adsorb on the surface of the toner particles. These types of polymers are described by Kosel (U.S. Pat. No. 3,900,412) and Tsubuko (U.S. Pat. No. 3,992,342) among others.

One particularly useful and preferred amphipathic copolymer can be prepared similar to the manner of Example XI of U.S. Pat. No. 3,900,412 in three steps as follows:

Part A—Copolymerize 3 wt. % glycidyl methacrylate with 97 wt. % lauryl methacrylate in Isopar H. The reaction temperature and monomer addition should be adjusted to produce a M.W. of about 40,000. About 0.5% azobisbutyronitrile can be used as an initiator.

Part B—Esterify about 25% of the oxirane groups from Part A with methacrylic acid to form pendant carbon-carbon double bond graft sites. All of the methacrylic acid should be esterified. Dodecyldimethylamine can be used as the esterification catalyst.

Part C—Polymerize about 8 wt. % of diethylaminoethyl methacrylate in the presence of the Part B to give the resultant graft-type amphipathic copolymer.

Preferred solution-type amphipathic copolymers are copolymers of diethylaminoethyl methacrylate (DEAMA) and lauryl methacrylate (LMA) made in the presence of free radical initiator (e.g., azobisisobutyronitrile).

The toner may also optionally contain a graft-type amphipathic copolymer (D) which is not in an interacting mixture with a maleic anhydride adduct of pololefin. Its addition is to aid the dispersion of the toner particles. The preferred graft-type amphipathic copolymer is one cited above from Example XI of U.S. Pat. No. 3,900,412.

In addition to giving superior dispersing properties, this preferred amphipathic copolymer also gives the toner particles strong, negative charges when maleic modified rosins are used as the nonpolymeric resin (1). Since the above polymer is essentially nonionic and is also a very weak base, its conductivity in Isopar H is very low (i.e., $<10^{11}$MHOS/cm at 1% solids). As such, it is not clear why the above preferred amphipathic copolymer gives the toners strong, negative charges having high mobilities with relatively high conductivities. It is believed that the above preferred amphipathic copolymer provides a local polar environment when absorbed on the toner surface which enables the deprotonation of some toner surface acid groups. In addition, there is evidence that the graft-type amphipathic copolymer solubilizes small fractions of the maleic modified rosin, leading to complex interactions between above preferred amphipathic copolymer, solubilized rosin, and the toner surface.

Another optional ingredient is an ionic or zwitterionic charge director (E) soluble in the carrier liquid.

Many are known in the art. Examples of negative charge directors include lecithin, basic calcium petronate, basic barium petronate, sodium dialkyl sulphosuccinate, and polybutylene succinimide, among many others. Examples of positive charge director agents include aluminum stearate, cobalt octoate, zirconium naphthenate, and chromium alkyl salicylate, among others.

Another optional ingredient is a carrier liquid insoluble charge adjuvant (F).

Charge adjuvants are used to improve the toner charging and mobility. This is especially true when using an ionic or zwitterionic-type charge director. It has been found that particularly useful negative charge adjuvants include carrier liquid insoluble phosphonated or sulfonated compounds, such as phosphoric acid. Examples of these types of charge adjuvants are described by Larson (U.S. Pat. No. 4,681,831) and Gibson (U.S. Pat. No. 4,891,286). Useful positive charge adjuvants include copolymers based upon vinyl pyridine or dimethylaminoethyl methacrylate, among others. Other types of charge adjuvants are known in the art and most may be used with the toners described herein.

Another optional ingredient is a wax (G). Toner redispersion properties can be improved somewhat by incorporating a small amount of wax into the toner during the ball milling step. The use of waxes for improving the toner redispersion properties are well-known in the art. However, it is not desirable to use more than 10 wt. % of wax as compared to the total toner solids or use more than 2 wt. % of wax as compared to the total liquid toner concentrate, otherwise both transparency and the toner concentrate viscosity will suffer. Particularly useful waxes include:

| | Melt Point (°F.) |
|---|---|
| Bayberry | 100–120 |
| Beeswax | 143.6–149 |
| Candelilla | 155–162 |
| Carnauba | 181–187 |
| Ceresine | 128–185 |
| Japan | 115–125 |
| Micro-crystalline | 140–205 |
| Montan | 181–192 |
| Ouricury | 180–184 |
| Oxidized microcrystalline | 180–200 |
| Ozokerite | 145–185 |
| Paraffines | 112–165 |
| Rice Bran | 169–180 |
| Spermaceti | 108–122 |

The colored predispersion (A); carrier liquid (B); external charge system (C); and optional components (D), (E), (F), and (G) are usually blended together and finely ground by use of a suitable ball mill. The preferred ball mill is of the attritor type, for example, an S-1Attritor available from Union Process Corp. of Akron, Ohio. However, other mills known in the art such as a pebble mill, vibration mill, sand mill, and the like, may also be used. The toner ingredients are normally ball milled at 20 to 50 wt % solids loading in the carrier liquid in order to prepare a high solids liquid toner concentrate. The goal of the ball milling step is to grind the colored predispersion (A) down to the following particle size ranges:

| | Acceptable | Most Preferred |
|---|---|---|
| Colored Predispersion (D) | 0.5 to 10 | 1 to 3 micron |

The lower limit of acceptable toner particle size is very dependent upon the average primary particle sizes of the colorant or pigment (3). An object of this invention is to significantly reduce or eliminate pigment interactions upon the toner charging and imaging properties. This is accomplished by encapsulating most, and preferably all, of the pigment surfaces within the toner particles. It is important that the minimum toner particle size be at least two times the average primary pigment particle size and preferably four times, or greater, than the average primary pigment particle size. A toner particle size in the 3 to 5 micron range is generally the upper limit for very high resolution imaging applications, although toner particle sizes up to 10 microns may be acceptable for many less demanding applications.

The acceptable and preferred ranges of the solids contents of components (A), (B), (C), (D), (E), (F), and (G) are as follows:

| | Acceptable Range | Preferred Range |
|---|---|---|
| Colored Predispersion (A) | 40–99.5% | 70–98% |
| External Charge System (C) | 0.5–20 | 2–8 |
| Graft-Type Amphipathic Copolymer (D) | 0–20 | 0–10 |
| Charge Director (E) | 0–5 | 0–1 |
| Charge Adjuvant (F) | 0–5 | 0–2 |
| Wax (G) | 0–30 | 0–10 |

After the ball milling step is completed, the toner is preferably diluted to 0.2 to 3 wt. % solids content in the carrier liquid for use in a printer or copier. Alternatively, all or part of the external charge system (C) may be added to the milled concentrate or to diluted working strength toner. This allows for easy adjustment of the desired charge of the toner.

Liquid color toner compositions of the present invention have the following properties:

1. Charge properties which are stable over time.
2. Charge properties which are predictable and reproducible.
3. Charge properties which are not influenced by most pigments.
4. Charge properties which are similar for different color toners—in other words, colorblind.
5. Toner particles which are totally charged to one polarity, i.e., all particles are positively charged or all are negatively charged.
6. Toner particles suitable for developing known photoreceptors at low, medium, and high development speeds.
7. Toners suitable for use in known contact electrostatic transfer processes, i.e., give good transfer efficiency.
8. Toners suitable for use in gap electrostatic transfer processes such as those described by Bujese (U.S. Pat. No. 4,786,576).
9. Toners capable of imaging at least 5 to 95% halftone dots using a 150 line screen ruling.
10. Toners capable of imaging at least a 10 micron line resolution.

11. Process color toners capable of imaging at Specifications for Web Offset Printing (S.W.O.P.) image densities.
12. Color toners capable of producing images which have transparencies equal to, or better than, those obtained by offset printing inks.
13. Toners which are free-flowing at more than 40% solids concentration and are suitable for use in a high solids replenishment system.
14. Toners which redisperse easily upon settling.
15. Toners which do not film-form upon settling.
16. Toners capable of fusing below 100° C.
17. Toners capable of excellent adhesion to paper, metal, plastic, or glass surfaces.
18. Toners capable of of imaging on conductive fluoropolymer substrates using a gap electrostatic transfer process.
19. Toners capable of transferring completely from a fluoropolymer substrate to a paper, metal, or plastic substrate.

The liquid color toner composition is especially suitable for use in a gap transfer xero-printing process, such as that described in U.S. Pat. No. 4,786,576, which is incorporated herein by reference. This patent describes a method of fabricating a toned pattern on an electrically isolated nonabsorbent conductive receiving surface, comprising the steps of:

(a) establishing a charged electrostatic latent image area on an electrostatically imageable surface;
(b) developing the electrostatic latent image area by applying to the electrostatically imageable surface charged toner particles of a predetermined height suspended in a liquid comprised at least partially of a nonpolar insulating solvent to form a first liquid layer with a first liquid surface, the charged toner particles being directed to the latent image area of the electrostatically imageable surface to form a developed latent image;
(c) applying to the conductive receiving surface a liquid comprised at least partially of a nonpolar insulating solvent to form a second liquid layer with a second liquid surface;
(d) establishing an electric field between the electrostatically imageable surface and the conductive receiving surface by connecting a D.C. voltage directly to the conductive receiving surface;
(e) placing the conductive receiving surface adjacent to the electrostatically imageable surface so that a gap is maintained therebetween, and the first liquid surface contacts the second liquid surface to create a liquid transfer medium across the liquid-filled gap, the liquid-filled gap being of a depth greater than the height of the toner particles;
(f) transferring the developed latent image from the electrostatically imageable surface at a point of transfer through the liquid to the conductive receiving surface to form a transferred toner particle image in an imaged area and defined nonimaged area where toner particles are absent;
(g) maintaining the gap during transfer of the developed latent image between the electrostatically imageable surface and the conductive receiving surface at the point of transfer between at least about 1 mil and about 20 mils; and
(h) fusing the transferred toner particles image to the conductive receiving surface.

Additionally, said process may include the following steps:

(a) etching the nonimaged areas of the conductive receiving surface to remove the conductive receiving surface from the nonimaged areas of the conductive receiving surface on the conductor laminate; and
(b) removing the toner particles from the imaged area.

Furthermore, said process may employ a conductive fluoropolymer receiving surface and the steps of removing the carrier liquid and transferring the toner off of the fluoropolymer receiving surface to a second receiving surface such as paper by heat and pressure means.

EXAMPLE 1

Preparation of Predispersion No. 1

The following compounds were combined together:

| Compound | Weight (Grams) |
|---|---|
| (a) Colorant[1] | 600 |
| (b) Plasticizer[2] | 240 |
| (c) Resin[3] | 2,160 |

[1]Irgalite Rubine LB4N available from Ciba-Geigy.
[2]Polyethylene Glycol 8000 available from Union Carbide.
[3]UNIREZ 8112 available from Union Camp.

The above compounds were first mixed together in a V-blender for 10 minutes in order to produce a homogeneous powder mixture. The mixture was next compounded (i.e., kneaded) by use of a Baker-Perkins twin screw compounder (extruder). The compounding conditions were as follows:

| | |
|---|---|
| Temperature | 180° F. (76° C.) |
| Screw Speed | 150 rpm |
| Feed Rate | 105 g/min. |

After compounding, the extrudate was coarse ground by use of corn mill. The resultant particle size was around ⅛ inch (⅓ centimeters).

EXAMPLE 2

Preparation of Predispersion No. 2

The following compounds were combined together:

| Compound | Weight (Grams) |
|---|---|
| (a) Colorant[1] | 600 |
| (b) Plasticizer[2] | 180 |
| (c) Resin[3] | 2,160 |
| (d) Maleic anhydride adduct of polyolefin[4] | 60 |

[1]Irgalite Rubine LB4N available from Ciba-Geigy.
[2]Polyethylene Glycol 8000 available from Union Carbide.
[3]UNIREZ 8112 available from Union Camp.
[4]CERAMER 1608 available from Petrolite.

The above compounds were first mixed together in a V-blender for 10 minutes in order to produce a homogeneous powder mixture. The mixture was next compounded (i.e., kneaded by use of a Baker-Perkins twin screw compounder (extruded). The compounding conditions were as follows:

| | |
|---|---|
| Temperature | 180° F. (76° C.) |
| Screw Speed | 150 rpm |

-continued

| | |
|---|---|
| Feed Rate | 105 g/min. |

After compounding, the extrudate was coarse ground by use of a corn mill. The resultant particle size was around ⅛ inch (⅓ centimeters).

EXAMPLE 3

Preparation of Polymer A

An amphipathic copolymer was made according to the following three-step procedure:

Part A—Copolymerize 3 wt. % glycidyl methacrylate with 97 wt. % lauryl methacrylate in Isopar H. The reaction temperature and monomer addition was adjusted to produce a M.W. of about 40,000. About 0.9% azobisbutyronitrile is used as an initiator.

Part B—Esterify about 25% of the oxirane groups from Part A with methacrylic acid to form pendant carbon-carbon double bond graft sites. All of the methacrylic acid should be esterified. Dodecyldimethylamine is used as the esterification catalyst.

Part C—Polymerize about 8 wt. % of methyl methacrylate in the presence of the Part B to give the resultant graft-type amphipathic copolymer.

EXAMPLE 4

Preparation of Liquid Toner No. 1

The following compounds were added into a 1 gallon Kady Mill (Kinetic Dispersion Corp.) and were milled for 15 minutes at <100° F. This reduced the toner particle size to about 100 microns.

| Compound | Weight (Grams) |
|---|---|
| Predispersion No. 1 | 327 |
| Polymer A | 149 |
| Wax[1] | 26 |
| Carrier Liquid[2] | 999 |

[1]Ross Wax 140 available from Ross.
[2]Isopar H available from Exxon.

After Kady milling, the blend was next poured into an S-1 attritor (Union Process Corp.) and milled for 4 hours at 250 rpm and 100–105° F. After 4 hours, the batch was cooled to 70° F., while milling continued for one additional hour. Next, the batch was diluted to 15% solids using 1,000 g of Isopar H. This was milled together for about 1 minute, after which the toner concentrate was drained and bottled.

EXAMPLE 5

Preparation of Liquid Toner No. 2

The following compounds were added into a 1 gallon Kady Mill (Kinetic Dispersion Corp.) and were milled for 15 minutes at <100° F. This reduced the toner particle size to about 100 microns.

| Compound | Weight (Grams) |
|---|---|
| Predispersion No. 2 | 327 |
| Polymer A | 149 |
| Wax[1] | 26 |
| Carrier Liquid[2] | 999 |

[1]Ross Wax 140 available from Ross.
[2]Isopar H available from Exxon.

After Kady milling, the blend was next poured into an S-1 attritor (Union Process Corp.) and milled for 4 hours at 250 rpm and 100–105° F. After 4 hours, the batch was cooled to about 70° F., while milling continued for one additional hour. Next, the batch was diluted to 15% solids using 1,000 g of Isopar H. This was milled together for about 1 minute, after which the toner concentrate was drained and bottled.

EXAMPLE 6 preparation of Polymer B

This polymer is almost identical to Polymer A made in Example 3 previously, except diethylaminoethyl methacrylate was used in place of methy methacrylate in the Part C. Its synthesis is summarized as follows:

Part A—Copolymerize 3 wt. % glycidyl methacrylate with 97 wt. % lauryl methacrylate in Isopar H. The reaction temperature and monomer addition should be adjusted to produce a M.W. of about 40,000. About 0.9% azobisisobutyronitrile is used as an initiator.

Part B—Esterify about 25% of the oxirane groups from Part A with methacrylic acid to form pendant carbon-carbon double bond graft sites. All of the methacrylic acid should be esterified. Dodecyldimethylamine can be used as the esterification catalyst.

Part C—Polymerize about 8 wt. % of diethylaminoethyl methacrylate in the presence of the Part B to give the resultant graft-type amphipathic copolymer.

This polymer is totally soluble in Isopar H and forms a clear solution in Isopar H.

EXAMPLE 7

Preparation of Polymer C

An amine-containing solution copolymer was prepared in a 2-liter reaction flask. 700 g of Isopar H was added and heated to 100° C., after which the following monomers/initiator were added over a 3 hour period:

| Compound | Weight (Grams) |
|---|---|
| DEAEMA (diethylaminoethyl methacrylate) | 30.0 |
| LMA (lauryl methacrylate) | 270.0 |
| Azobisisobutyronitrile | 2.7 |

After the monomer addition was complete, the copolymer was heated at 100° C. for an additional 5 hours to complete the reaction.

This polymer is totally clear and soluble in Isopar H.

EXAMPLE 8

Preparation of Charge Additive No. 1

A toner charge additive, containing Polymer A, was prepared using the following compounds:

| Compound | Weight (Grams) |
|---|---|
| Polymer A | 250 |
| Maleic anhydride adduct of polyolefin[1] | 75 |
| Liquid Carrier[2] | 250 |

[1]CERAMER 1608 available from Petrolite.
[2]Isopar H available from Exxon Corporation.

The above compounds were heated to 110° C. and agitated in a 1-liter round-bottom flask, which was previously purged with $N_2$ gas. Upon reaching 110° C., mixture was next cooled to room temperature.

This toner charge additive is totally soluble and clear in Isopar H at 50° C. However, at room temperature, the solution becomes opaque and some of the maleic anhydride adduct of pololefin precipitates to the bottom of the container.

EXAMPLE 9

Preparation of Charge Additive No. 2

A toner charge additive, containing Polymer B, was prepared using the following compounds:

| Compound | Weight (Grams) |
|---|---|
| Polymer B | 250 |
| Maleic anhydride adduct of polyefin[1] | 75 |
| Liquid Carrier[2] | 250 |

[1]CERAMER 1608 available from Petrolite.
[2]Isopar H available from Exxon Corporation.

The above compounds were heated to 110° C. and agitated in a 1-liter round-bottom flask, which was previously purged with $N_2$ gas. Upon reaching 110° C., mixture was next cooled to room temperature.

This toner charge additive is totally soluble and clear in Isopar H at 50° C. However, at room temperature, the solution becomes Opaque and some of the maleic anhydride adduct of pololefin precipitates to the bottom of the container.

EXAMPLE 10

Preparation of Charge Additive No. 3

A toner charge additive, containing Polymer C, was prepared using the following compounds:

| Compound | Weight (Grams) |
|---|---|
| Polymer C | 250 |
| Maleic anhydride of adduct polyolefin[1] | 75 |
| Liquid Carrier[2] | 250 |

[1]CERAMER 1608 available from Petrolite.
[2]Isopar H available from Exxon Corporation.

The above compounds were heated to 110° C. and agitated in a 1-liter round-bottom flask, which was previously purged with $N_2$ gas. Upon reaching 110° C., mixture was next cooled to room temperature.

This toner charge additive is totally soluble and clear in Isopar H at 50° C. However, at room temperature, the solution becomes opaque and some of the maleic anhydride adduct of pololefin precipitates to the bottom of the container.

CONDUCTIVITY MEASUREMENTS

The conductivities (i.e., charge magnitude) of Toner Nos. 1 and 2; Polymers A, B, and C; and Charge Additives Nos. 1, 2, and 3, as well as CERAMER 1608 in Isopar H were measured using an Andeen-Hagerling 1 khz capacitance bridge. The results of these measurements are shown in Table 1.

The data in Table 1 shows that there is very little charge development when the individual polymers are diluted in Isopar H. However, when a anhydride adduct of pololefin is combined with an amine-containing (or even neutral MMA containing) solubilizing copolymer, there is a dramatic increase in charge development.

Also, notice that Toner No. 2 (containing CERAMER 1608) has a noticeably higher conductivity than Toner No. 1. We believe that this charge increase is due to an interaction between the CERAMER 1608 and Polymer A.

TABLE 1

| Conductivities | | |
|---|---|---|
| Compound | Concentration | Conductivity (nS/cm) |
| Toner No. 1 | 10,000 PPM | 0.89 |
| Toner No. 2 | 10,000 PPM | 5.70 |
| Polymer A | 600 PPM | 1.00 |
| Polymer B | 600 PPM | 0.81 |
| Polymer C | 600 PPM | 0.23 |
| Charge Additive No. 1 | 600 PPM | 10.00 |
| Charge Additive No. 2 | 600 PPM | 47.02 |
| Charge Additive No. 3 | 600 PPM | 21.57 |
| CERAMER 1608 | 600 PPM | 0.57 |

PRINTING PERFORMANCE OF TONER NO. 1 WITH ADDITIVES

A toner premix was made by mixing 166 grams of Toner No. 1 with 2,333 grams of Isopar H. This is equivalent to 1% solids. Various amounts of Polymers B or C or charge additives 2 or 3 were then added to the premix. Each additive was directly added into the toner in the developer tray and allowed to mix for 5 minutes prior to use. Each of the charge additives was heated to 50° C. in order to dissolve the CERAMER 1608 prior to use. A Savin 5030 Copier was used for all print tests. Conductivity of the resulting mixtures was measured by using an Andeen-Hagerling 1 khz capacitance bridge. Image Density (I.D.) was measured by using an X-rite 404 reflectance densitometer. The results of these printing performance evaluations are shown in Table 2.

PRINTING PERFORMANCE OF TONER NO. 2 WITH ADDITIVES

A toner premix was made by mixing 166 grams of Toner No. 2 with 2,333 grams of Isopar H. Various amounts of Polymers B or C or charge additives 2 or 3 were then added to the premix. This is equivalent to 1% solids. Each additive was directly added into the toner in the developer tray and allowed to mix for 5 minutes prior to use. Each of the charge additives was heated to 50° C. in order to dissolve the CERAMER 1608 prior to use. A Savin 5030 Copier was used for all print tests. Conductivity of the resulting mixtures was measured by using an Andeen-Hagerling 1 khz capacitance bridge. Image Density (I.D.) was measured by see p. 12. The results of these printing performance evaluation are shown in Table 3.

TABLE 2

| Print Data for Toner 1 | | | | | |
|---|---|---|---|---|---|
| Example | Additive | Amount (ppm) | Conductivity (nS/cm) | I.D. | Resolution LP/mm |
| 11 | None | — | 0.89 | 0.54 | 4.5 |
| 12 | Polymer B | 240 | 2.35 | 0.26 | 5.0 |
| 13 | Polymer B | 480 | 3.11 | 0.20 | 4.5 |
| 14 | Polymer B | 720 | 5.06 | 0.17 | 3.0 |
| 15 | Polymer C | 240 | 1.48 | 0.22 | 3.6 |
| 16 | Polymer C | 480 | 1.31 | 0.25 | 3.6 |
| 17 | Polymer C | 720 | 1.18 | 0.26 | 4.0 |
| 18 | Charge Add. 2 | 240 | 12.56 | 0.21 | 3.6 |
| 19 | Charge Add. 3 | 240 | 9.42 | 0.71 | 5.0 |
| 20 | Charge Add. 3 | 480 | 17.87 | 0.76 | 5.6 |
| 21 | Charge Add. 3 | 720 | 26.10 | 0.73 | 5.6 |

TABLE 3

| Example | Additive | Print Data for Toner 2 Amount (ppm) | Conductivity (nS/cm) | I.D. | Resolution LP/mm |
|---|---|---|---|---|---|
| 22 | None | — | 5.70 | 1.13 | 4.0 |
| 23 | Polymer B | 240 | 5.93 | 0.95 | 4.5 |
| 24 | Polymer B | 480 | 6.05 | 0.83 | 5.0 |
| 25 | Polymer B | 720 | 8.48 | 0.75 | 5.0 |
| 26 | Polymer C | 240 | 4.76 | 0.80 | 5.0 |
| 27 | Polymer C | 480 | 4.19 | 0.85 | 5.6 |
| 28 | Polymer C | 720 | 3.93 | 0.86 | 5.0 |
| 29 | Charge Add. 2 | 240 | 12.79 | 1.11 | 5.6 |
| 30 | Charge Add. 2 | 480 | 35.08 | 1.15 | 6.3 |
| 31 | Charge Add. 3 | 240 | 9.37 | 1.27 | 6.3 |
| 32 | Charge Add. 3 | 480 | 23.13 | 1.25 | 6.3 |

What is claimed is:

1. A liquid toner composition comprising:

A. a colored predispersion comprising a homogeneous mixture of at least one nonpolymeric resin material, at least one polymeric plasticizer, at least one colorant material and at least one maleic anhydride adduct of polyolefin;

(1) said nonpolymeric resin material characterized by:

(aa) being insoluble and nonswellable in the liquid carrier;

(bb) having a melting point between 60° to 180° C.; and (cc) having an acid number higher than about 100;

(2) said polymeric plasticizer characterized by:

(aa) being soluble in said nonpolymeric resin;

(bb) being insoluble in the liquid carrier;

(cc) having a melting point from about 35° C. to about 70° C.; and (3) said colorant material having an average primary particle size of less than about 0.5 microns;

(4) said maleic anhydride adduct of polyolefin characterized by (aa) being partially soluble in the liquid carrier; and (bb) having an acid number higher than about 45; and wherein said colored predispersion contains about 50% to about 98.5% by weight nonpolymeric resin; about 1.0% to 20% by weight polymeric plasticizer; about 0.5% to 30% by weight colorant material and about 0.5 to about 10% by weight anhydride adduct of polyolefin; and B. an aliphatic hydrocarbon carrier liquid having a conductivity of $10^{-9}$ MHOS/$_{cm}$ or less, a dielectric constant of 3 or less, and a flash point of 100° F. or greater; and C. external charge system comprising an interacting mixture of a maleic anhydride adduct of polyolefin and an amphipathic copolymer, said maleic anhydride adduct of polyolefin characterized by:

(aa) being partially soluble in the liquid carrier; and (bb) having an acid number higher than about 45; the weight ratio of said anhydride adduct of polyolefin and amphipathic copolymer being from about 1:10 to about 10:1;

wherein said toner containing about 0.1% to about 10% by weight colored predispersion and about 99.9% to about by weight of said liquid carrier and about 0.005% to about 0.25% of said external charge system and said colored predispersion particles having about 0.5–10 micron average particle size and being insoluble and nonswellable in said liquid carrier.

2. The liquid toner of claim 1 wherein said nonpolymeric resin is a maleic modified rosin.

3. The liquid toner of claim 1 wherein said polymeric plasticizer is a polyethylene glycol having a molecular weight from about 1,000 to about 10,000.

4. The liquid toner of claim 1 wherein said colorant material is a pigment material.

5. The liquid toner of claim 1 wherein said colored predispersion comprises a homogeneous mixture of a maleic modified rosin, a polyethylene glycol having a molecular weight from about 1,000 to about 10,000, and a pigment material.

6. The liquid toner of claim 5 wherein said maleic modified rosin is about 70% to about 90% by weight of the colored predispersion.

7. The liquid toner of claim 6 wherein said polyethylene glycol having a molecular weight from about 1,000 to about 10,000 is about 5% to about 15% by weight of the colored predispersion.

8. The liquid toner of claim 6 wherein said organic or inorganic pigment material is from about 5% to about 15% by weight of said colored predispersion.

9. The liquid toner of claim 1 wherein said liquid toner additionally contains a graft amphipathic copolymer (D) in an amount from 0% to about 20% by weight of the solids of said liquid toner.

10. The liquid toner of claim 1 wherein said liquid toner additionally contains a ionic or zwitterionic charge director (E) soluble in said liquid carrier in an amount from 0% to about 5% by weight of the solids of said liquid toner.

11. The liquid toner of claim 1 wherein said liquid toner additionally contains a charge adjuvant (F) in the amount from 0% to about 5% by weight of the solids content of said toner.

12. The liquid toner of claim 1 wherein said liquid toner additionally contains a wax in the amount from about 0% to about 30% by, weight of the solids content of said toner.

13. The liquid toner of claim 1 wherein said solids content of said liquid toner is from about 0.2% to about 3% by weight.

14. A liquid toner concentrate composition comprising:

A. a colored predispersion comprising a homogeneous mixture of at least one nonpolymeric resin material, at least one polymeric plasticizer, at least one colorant material and at least one maleic anhydride adduct of polyolefin;

(1) said nonpolymeric resin material characterized by:

(aa) being insoluble and nonswellable in the liquid carrier;

(bb) having a melting point between 60° to 180° C.; and (cc) having an acid number higher than about 100;

(2) said polymeric plasticizer characterized by:

(aa) being soluble in said nonpolymeric resin;

(bb) being insoluble in the liquid carrier;

(cc) having a melting point from about 35° C. to about 70° C.; and (3) said colorant material having an average primary particle size of less than about 0.5 microns;

(4) said maleic anhydride adduct of polyolefin characterized by (aa) being partially soluble in the liquid carrier; and (bb) having an acid number higher than about 45; and wherein said colored predispersion contains about 50% to about 98.5% by weight nonpolymeric resin; about 1.0% to 20% by weight polymeric plasticizer; about 0.5% to 30% by weight colorant material and about 0.5 to about 10% by weight anhydride adduct of polyolefin; and B. an aliphatic hydrocarbon carrier liquid having a conductivity of $10^{-9}$ MHOS/$_{cm}$ or less, a dielectric constant of 3 or less, and a flash point of 100° F. or greater; and C. external charge system comprising an interacting mixture of a maleic anhydride adduct of polyolefin and an amphipathic copolymer, said maleic anhydride adduct of polyolefin characterized by:

(aa) being partially soluble in the liquid carrier; and (bb) having an acid number higher than about 45; the weight ratio of said maleic-modified wax and amphipathic copolymer being from about 1:10 to about 10:1;

wherein said toner concentrate containing about 20% to about 50% by weight solids and about 80% to about 50% by weight of said liquid carrier and about 0.005% to about 0.25% of said external charge system and said colored predispersion particles having about 0.5–10 micron average particle size and being insoluble and nonswellable in said liquid carrier.

* * * * *